United States Patent [19]

Falk

[11] Patent Number: 4,772,215

[45] Date of Patent: Sep. 20, 1988

[54] ELECTRICAL CONNECTOR WITH ENCLOSED INTERNAL SWITCH

[75] Inventor: Edward J. Falk, St. Louis, Mo.

[73] Assignee: Hubbell Incorporated, Orange, Conn.

[21] Appl. No.: 108,633

[22] Filed: Oct. 15, 1987

[51] Int. Cl.[4] ..... H01R 13/703

[52] U.S. Cl. ..... 439/188; 200/51.09; 439/333

[58] Field of Search ..... 439/188, 333; 200/51.03, 51.07, 51.08, 51.09, 51.1, 51.11, 51.12, 51.13

[56] References Cited

U.S. PATENT DOCUMENTS

| | | | |
|---|---|---|---|
| 2,857,486 | 10/1958 | Hubbell | 200/51.09 |
| 2,986,612 | 5/1961 | Healy | 200/51 |
| 3,330,920 | 7/1967 | Appleton | 200/51.07 |
| 3,475,570 | 10/1969 | Appleton | 200/51.07 |
| 3,585,323 | 6/1971 | Appleton | 200/50 B |
| 4,185,881 | 1/1980 | Foley et al. | 339/41 |
| 4,359,255 | 11/1982 | Gallusser et al. | 339/90 |
| 4,520,243 | 5/1985 | McIntyre | 200/51.07 |
| 4,553,000 | 11/1985 | Appleton | 200/50 B |
| 4,659,160 | 4/1987 | Jonval | 339/111 |

*Primary Examiner*—Neil Abrams

*Attorney, Agent, or Firm*—Jerry M. Presson; Walter C. Farley

[57] ABSTRACT

A connector has a tubular body with first and second insulating bodies held therein. The first body is at the front, exposed end of the connector and has electrically conductive components for receiving the blades of a plug. The rear of the first body and the front of the second body have axially extending switch contacts which are brought into contact by rotation of the first body. Rotation is prevented by a locking ring nonrotatably coupled to the first body and engaging lugs at the front end of the connector. The locking ring is released from the lugs by axial force supplied by full insertion of the plug.

12 Claims, 4 Drawing Sheets

FIG. 1.
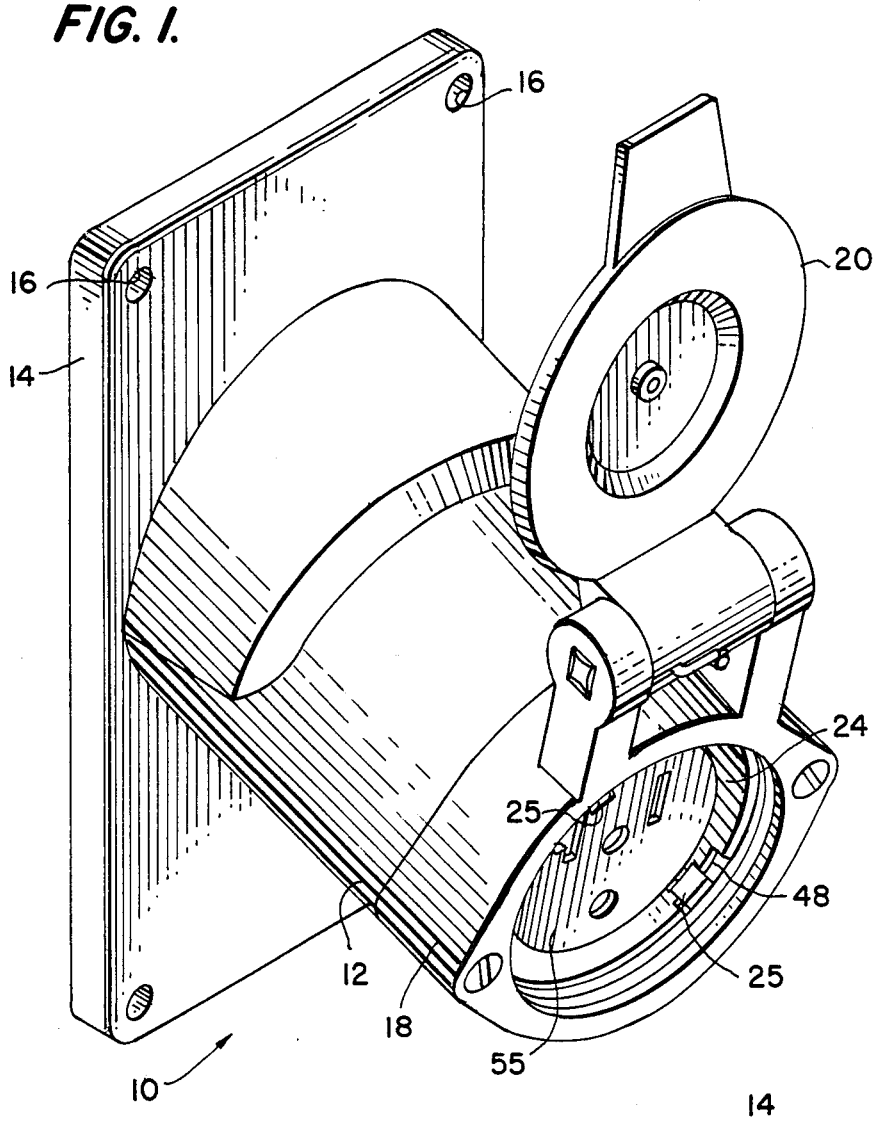
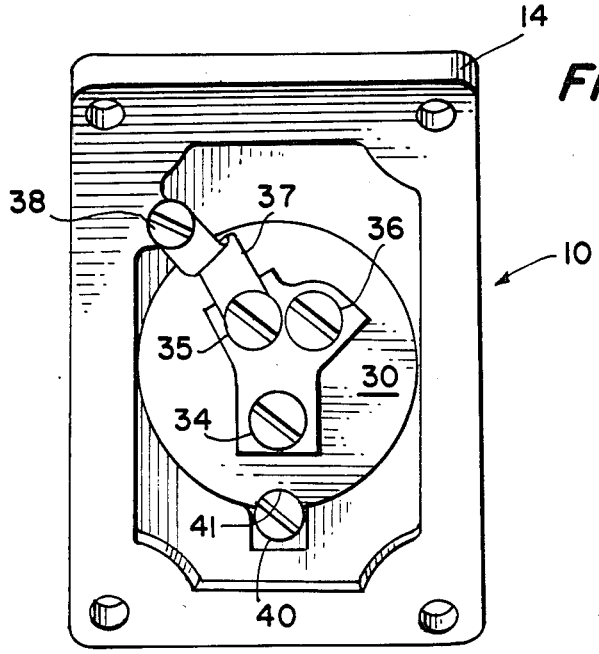
FIG. 3.

ELECTRICAL CONNECTOR WITH ENCLOSED INTERNAL SWITCH

This invention relates to a plug and connector wherein the connector is provided with an internal, completely enclosed switch and wherein motion of the plug and a portion of the connector after the two have been joined closes the switch.

BACKGROUND OF THE INVENTION

Electrical connectors for use in locations having potentially hazardous atmospheres are often made so that any exposed electrical components which are being brought into mechanical contact with each other are not energized until after the physical contact has been competed. For this purpose, it is desirable to provide a switch within the connector receptacle and to arrange the switch so that it can be closed only after the components have been joined.

While connectors for this general purpose have been devised previously, such connectors are generally quite complicated and therefore rather expensive to produce. In some cases, the connectors are not fail safe, i.e., it is possible to defeat the switching mechanism and energize the receptacle before insertion of the plug.

SUMMARY OF THE INVENTION

Accordingly, an object of the invention is to provide a plug and receptacle or connector in which a switching mechanism is provided, the switching mechanism being completely enclosed and being closable only after the plug has been inserted into the receptacle.

A further object is to provide such a structure which has relatively few components and is simple to manufacture and assemble.

A still further object is to provide such a structure in which the switching mechanism cannot inadvertently be defeated.

Briefly described, the invention includes a connector receptacle for receiving the protruding blades of a plug comprising a generally tubular body having a circular cylindrical internal passage therethrough, the passage having a front end and a rear end, and a first body of electrical insulating material with a cylindrical exterior dimensioned to be rotatably received in the passage adjacent the front end. A first body includes means defining electrically conductive female contact members exposed at one end of the body in positions for receiving and making electrical contact with the blades of the plug. The first body also has means defining a first plurality of switch contact members extending axially from a surface at the rear end of the first body, the switch contact members being electrically connected to the female members. A second body of insulating material is also received in the passage, the second body having a front end facing toward the first body and including means defining a second plurality of switch contact members extending axially at the front end of the second body toward the first body, the second plurality of contact members axially overlapping the first plurality of contact members. Terminal means are provided at the rear end of the second body for connection to wires. The second body is locked against rotation relative to the passage. At the front end of the passage is releasable stop means for limiting the extent of rotation of the first body and holding that body in a position in which the switch contacts are separated from each other, the stop means being releasable to allow rotation of the first body through a predetermined angle to a second position in which the pluralities of contact members are in contact in pairs, thereby electrically connecting the blades with the terminal means. Release of the stop means is accomplished by insertion of a plug after which the plug and the first body are rotated to close the switch.

BRIEF DESCRIPTION OF THE DRAWINGS

In order to impart full understanding of the manner in which these and other objectives are attained in accordance with the invention, particularly advantageous embodiments thereof will be described with reference to the accompanying drawings, which form a part of this specification, and wherein:

FIG. 1 is a perspective view of a connector receptacle in accordance with the invention;

FIG. 3 is a rear view of the apparatus of FIGS. 1 and 2;

DESCRIPTION OF THE PREFERRED EMBODIMENT

Figure 2:
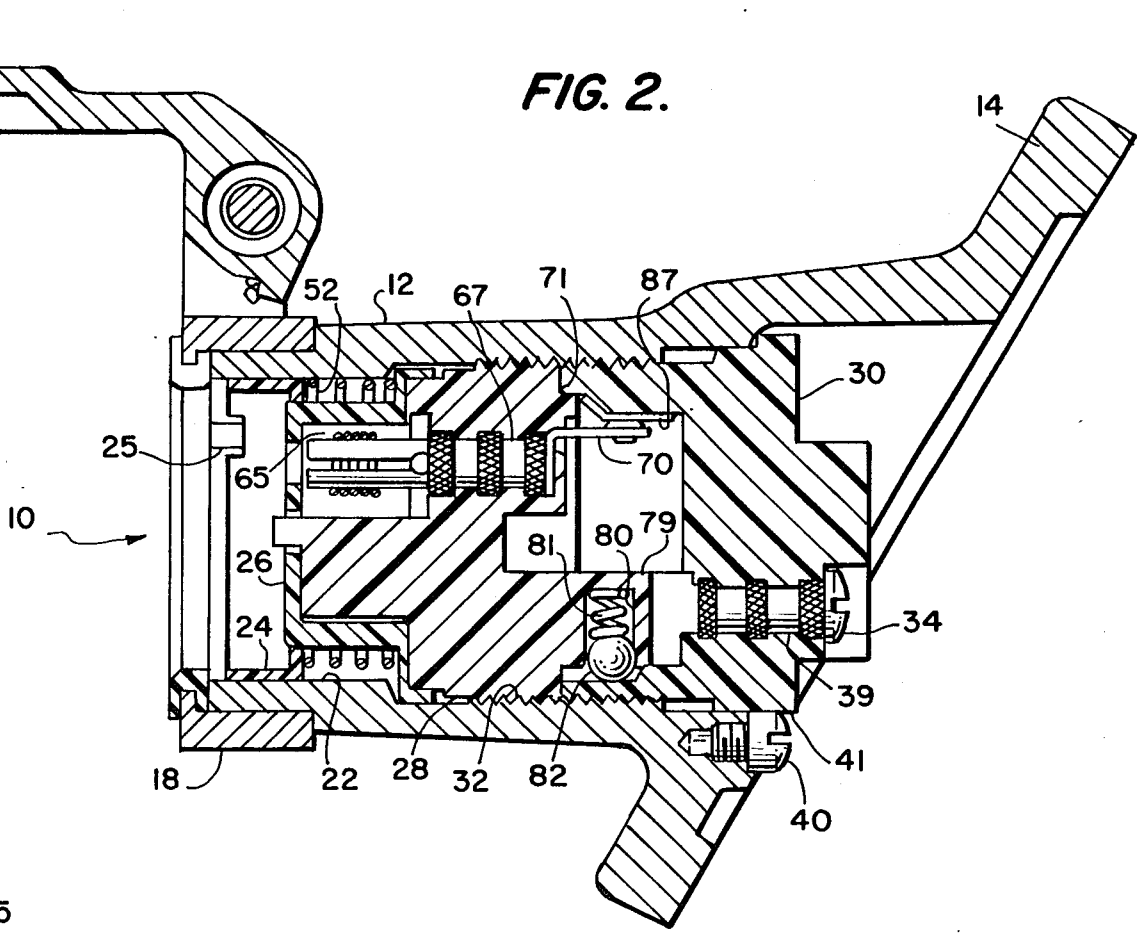
FIG. 2 is a side elevation, in section, of the apparatus of FIG. 1.

Referring first to FIG. 1, a connector receptacle indicated generally at 10 in accordance with the present invention includes a housing having a generally tubular metal body 12 which is attached to, and preferably unitarily formed with, a mounting plate 14. Plate 14 is dimensioned to be connected to an explosion proof wiring or outlet box, not illustrated and is provided with a plurality of holes 16 through which fasteners can be passed for this purpose. It will be observed that body 12 is not perpendicular to the mounting plate 14 but, rather, is inclined at an angle of approximately 45° for the purpose of avoiding collection of any liquid in the electrical portions thereof.

At the front end of housing 12 is a mounting ring 18 which supports a cover 20, the cover being hinged so that it is swingable between open and closed positions, and being spring loaded so that it is urged to its closed position unless held open either manually or by the presence of a plug in the receptacle.

As best seen in FIGS. 2 and 3, the tubular body 12 has an internal passage 22 therethrough, the passage being generally cylindrical and graduated in diameter to receive various components therein. Beginning at the front end of the connector to which mounting ring 18 is attached, the passage 22 receives an annular locking ring, a shell 26 which assists in the positioning of various components and also establishes unambiguously the plug blade arrangement which will be acceptable by the receptacle, a first molded body of substantially rigid electrical insulating material 28 and a second body of electrical insulating material 30. A portion of the interior wall of passage 28 is internally threaded at 32 and portions of the outer surfaces of bodies 28 and 30 are externally threaded so that they can be screwed into the housing from the rear. This threading also permits and guides rotational movement for switch opening and closing.

As best seen in FIG. 3, the rear end of body 30 is provided with terminal screws 34, 35 and 36 to which wires can be connected, terminal 35 being a ground terminal. A metal ground strap 37 is connected between screw 35 and a screw 38 which is threaded into the metal body of mounting plate 14 to connect electrical ground to the system ground. As previously indicated, plate 14 and body 12 are preferably unitarily formed and can be a cast metal such as aluminum. The terminal screws 34–36 enter electrically conductive, internally threaded sleeves which pass through body 30 and are attached to contact members as will be described. FIG. 2 shows one such sleeve 39 which receives screw 34 and extends into body 30. A locking screw 40 is threadedly received in a hole in the mounting plate 14, the head of screw 40 lying in an arcuate recess 41 in body 30. When screw 40 is in place, body 30 is prevented from rotating relative to passage 22.

Figure 4:
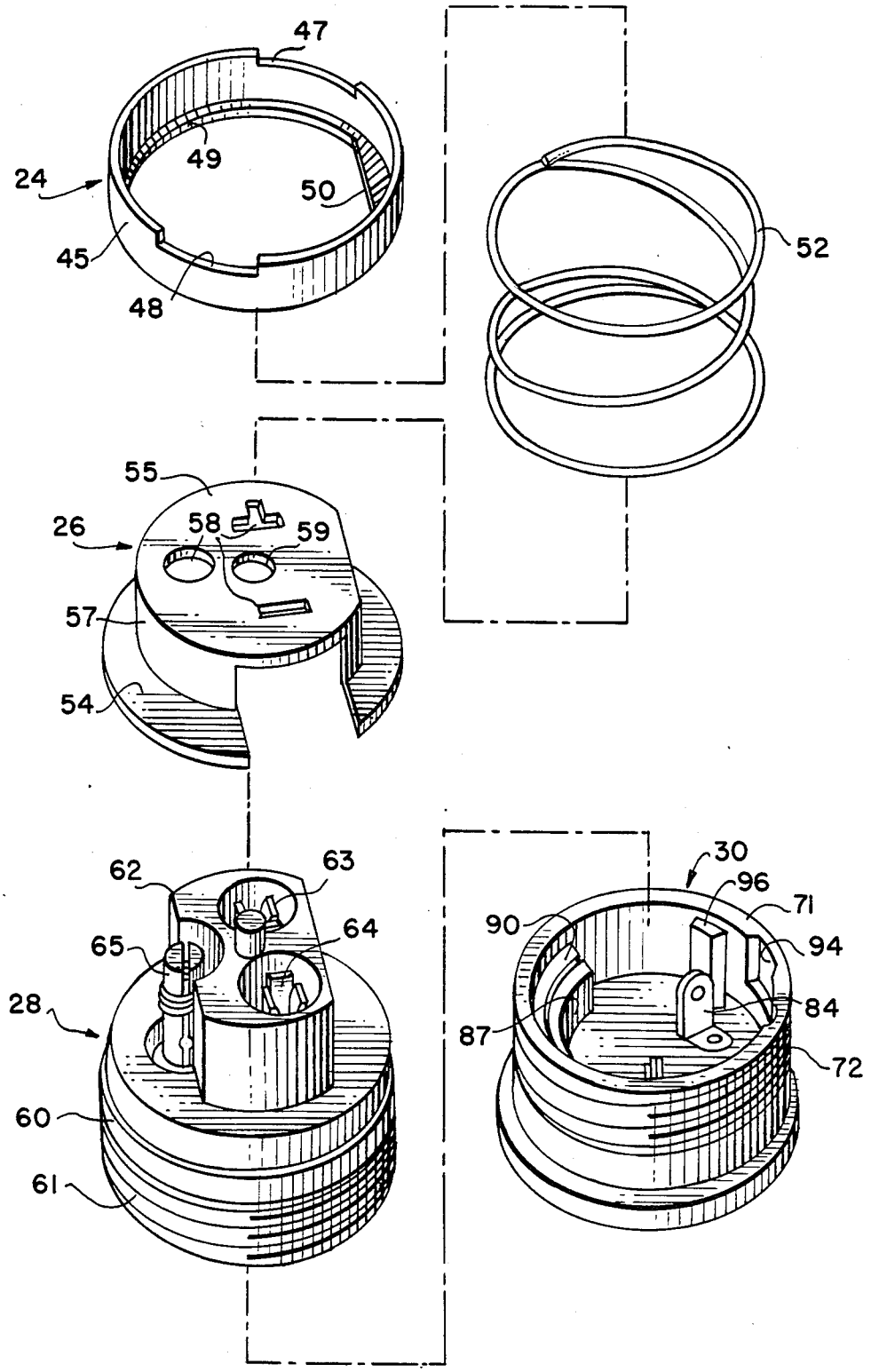
FIG. 4 is an exploded view of the components within the receptacle of FIGS. 1–3.

The individual components within passage 22 are separately shown in FIG. 4 in an exploded view which illustrates the sequence in which they are inserted and cooperate within the connector. Locking ring 24 has a rather short, cylindrical wall 45 which is formed with two recesses 47 and 48 on opposite sides of the forward end of the wall. At the rear end of wall 45 is a radially inwardly extending flange 49 which is made non-circular by a chordal segment 50 at one side. Returning to FIG. 1, at the front end of passage 22 it will be seen that body 12 is provided with two radially inwardly protruding lugs 25, one of which is also visible in FIG. 2. These lugs are mentioned at this time because they cooperate with recesses 47 and 48 in locking ring 24.

A compression coil spring 52 presses against the rear surface of locking ring 24 and urges the locking ring toward lugs 25. The other end of spring 52 presses against a flange 54 which is formed on shell 26, the shell including a front wall 55 and a non-circular side wall 57 which is shaped to mate with the non-circular opening defined by flange 49 and chordal member 50 in the locking ring. Plate 55 has openings 58 through which the blades of a plug can pass and a central opening 59 which properly positions the shell relative to body 28 during assembly.

Body 28 has a generally cylindrical portion 60, part of which is externally threaded as shown at 61 so that it can be threaded into passage 22. At the forward end of body 28 is a non-circular boss 62 which engages shell 26 and which provides a housing for spring members 63 and 64 and a tubular member 65 which are positioned to receive the plug blades extending through openings 58. Components 63, 64 and 65 are of a generally conventional configuration, component 65 being shaped to receive a ground blade or prong of a connector and spring members 63 and 64 being designed to receive a flat blade in either of two orthogonal positions. Which position can be accepted by the connector is determined by the shape and orientation of openings 58.

Each of components 63, 64 and 65 is fixedly attached to a sleeve such as sleeve 67, seen in FIG. 2, which is molded into body 28 and extends through the body, the other end of the sleeve being connected to an L-shaped electrical contact 70 which protrudes from the rear of body 28.

The second electrically non-conductive body 30 has an annular wall at its forward end, the outer surface of this wall being externally threaded at 72 to be received by threads 32 immediately adjacent body 28. Surrounded by wall 71 are contact members which cooperate with the contact members of body 28. These will be described with reference to FIGS. 5 and 6 which, respectively, show a rear end view of body 28 and a front end view of body 30.

Figure 5:
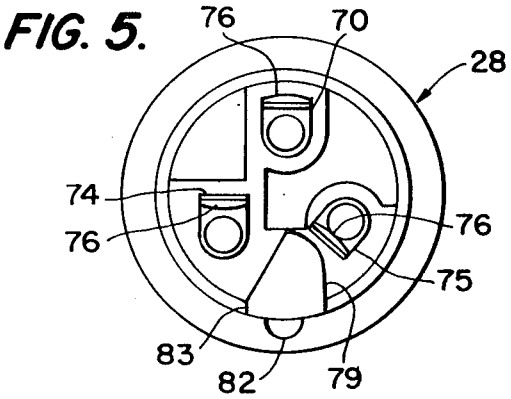
FIG. 5 is a rear end view of a first one of the bodies within the receptacle.

Referring first to FIG. 5, it will be seen that the rear end of body 28 includes, in addition to contact 70, contact members 74 and 75 which are electrically connected by sleeves such as sleeve 67 to spring members 63 and 64, respectively. Each of these contact members is generally L-shaped, having a configuration as shown in FIG. 2. The L-shaped portion is formed from an electrically conductive spring material such as phosphor bronze or the like and has a highly conductive contact button 76 riveted or otherwise firmly attached to one face thereof. Thus, each contact member lies along a line and in a plane which is parallel with the central axis of the body. Because these members will close electrical circuits upon rotation of body 28 relative to body 30, they will be referred to as switch contact members.

FIG. 5 also shows a molded housing 79, seen in section in FIG. 2, which protrudes from the back of body 28, the housing having a radial passage 80 therein which receives a compression coil spring 81 and a detent ball 82, the spring tending to urge the ball radially outwardly. Ball 81 cooperates with indentation detent surfaces 92 and 94 in body 30.

Figure 6:
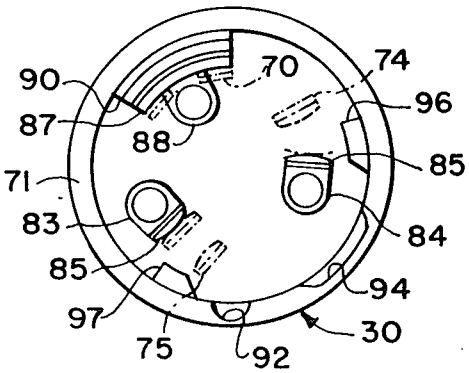
FIG. 6 is a front end view of a second body within the apparatus.

Turning now to FIG. 6, it will be seen that the circular cavity surrounded by wall 71 includes contact members 83 and 84 which are substantially identical in structure to contact members 70, 74 and 75 and have button contacts 85 thereon. In addition, body 30 has a ground contact 87 which comprises an arcuate plate of electrically conductive material having a concave, radially inwardly facing surface. The bottom of plate 87 is attached to an L-shaped foot portion 88 which is riveted to a sleeve such as sleeve 39, as are contact members 83 and 84, for connection to the terminal screws shown in FIG. 3. An arcuate plastic body 90 is formed on the inner surface of wall 71 to provide solid backing for contact member 88 so that it cannot bend radially outwardly.

On the opposite side of wall 71 from the location of contact 87 are indentations 92 and 94 which receive detent ball 82. Recess 92 is semicircular and receives ball 82 when body 28 has been rotated to the contact closing position. Recess 94 receives ball 82 when the body is rotated to the contact opening position. It will be noted that recess 94 is elongated in the circumferential direction, allowing some movement of body 28 relative to body 30 without having any electrical effect. This movement is equivalent to the difference in angular extent between recesses 47, 48 and lugs 25. On the interior of wall 71 is also provided a stop member 96 against which a surface 83 of the ball detent housing abuts when the bodies are positioned with the contacts farthest apart.

Figure 7:
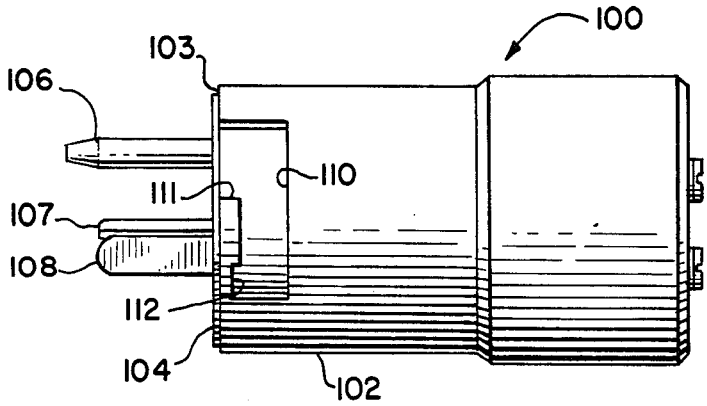
FIG. 7 is a side elevation of a plug usable with the receptacle of FIGS. 1–3.

A plug indicated generally at 100 which is suitable for use with the receptacle discussed above is shown in FIG. 7. The plug comprises a generally cylindrical body 102 having a rim 103 and an end face 104 from which blades 106, 107 and 108 extend. In the embodiment shown, blade 106 is in the shape of a circular prong rather than a flat blade and constitutes the grounding member. On opposite sides of body 102 are generally L-shaped recesses 110, one such recess being visible in FIG. 7. The other recess is, of course, identical and on the opposite side. Each recess includes an inlet portion 111 into which a lug 25 can slide as the plug is pushed axially into the receptacle. The plug can then be rotated after sufficient axial movement so that the lug slides across the circularly extending portion of the recess in the familiar bayonet connector movement.

Internally, the plug includes the usual electrical connecting devices for electrically associating each of the blades with a wire in a cable which can be received in the opposite end of the plug.

Figure 8:
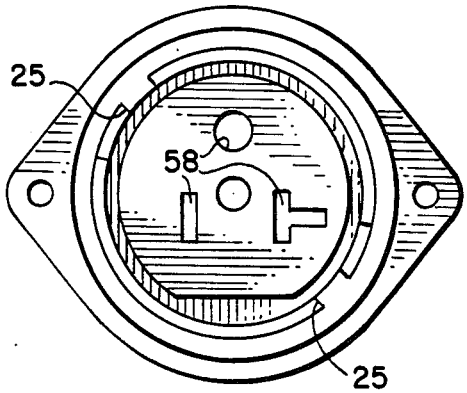
FIG. 8 is a front end elevation of the connector of FIGS. 1–3.

FIG. 8 shows an end view of tubular body 12 with the mounting ring 18 and cover 20 removed. The operation of the apparatus can now be described. Initially, with the plug separated from the receptacle, contacts 74 and 75 are in the separated positions schematically indicated in FIG. 6 and contact 70 is in the counter clockwise position shown in that figure. Thus, spring members 63 and 64 are deenergized. It will be assumed that contact members 83 and 84 and their associated screw terminals shown in FIG. 3 are connected to wires which supply electrical power.

To assemble the plug, the blades 106–108 are inserted into openings 58 in the receptacle, this axial insertion being continued until lugs 25 have entered recesses 110. When blades 106–108 make physical contact with members 63–65 in body 28, no electrical power is supplied to any of the components. When the lugs have moved as far as they can into recess 110, the plug is rotated clockwise, the blades in the conductive members carried by body 28 causing that body to also rotate clockwise carrying contacts 74 and 75 into abutment with contacts 84 and 83, respectively. Contact 70 slides from one end of arcuate contact 87 to the other. At this point, the circuits are closed and power is supplied to blades 106–108. The switch closing has occurred within the chamber defined by wall 71 and the end faces of bodies 28 and 30, a completely enclosed chamber. This is particularly important because if an explosive mixture should migrate into the chamber and be ignited by the switch closing, the closed and firmly held chamber functions to contain the explosion.

In order to accomplish this rotation, rim 103 engages the end face of locking ring 24 and, during the last portion of the axial movement of plug 100 into the receptacle, locking ring 24 is moved axially against the force of spring 52 so that the end face of ring 24, and not only recesses 47 and 48, are clear of lugs 25, permitting the locking ring, shell 26 and body 28 to be rotated. Until the plug is inserted to the point at which locking ring 24 is axially moved away from the lugs, no rotation beyond that permitted by the axial extent of recesses 47 and 48 is possible. Spring 52 is preferably selected to be quite strong so that force applied against the relatively narrow edge of locking ring 24 by some tool other than the end rim 103 of plug 102 is ineffective to move the entire locking ring to the extent necessary. This engagement between rim 103 and ring 24 is important because the dimensional relationships are such that a miscellaneous tool or a plug not intended for this use cannot readily operate the switch. Thus, placing a screw driver on the locking ring, for example, and attempting to move it is extremely difficult, if not impossible, because of the narrow edge of the locking ring and the spring strength. It is important that plugs which could be connected to equipment that is not explosion proof be excluded from operating this switch.

When the plug is released after insertion and rotation, lugs 25 enter a small recess 112 at the end of recess 110 under the force of spring 52 which presses locking ring 24 against the face of the plug. Thus, in order to remove the plug, slight axial inward movement is again necessary, followed by counter rotation and extraction of the plug. During the rotation, of course, the contacts are again opened, leaving the terminals unpowered when the plug blades are extracted.

While one advantageous embodiment has been chosen to illustrate the invention it will be understood by those skilled in the art that various changes and modifications can be made therein without departing from the scope of the invention as defined in the appended claims.

What is claimed is:

1. A connector receptacle for receiving protruding blades of a plug for completing an electrical connection, said connector having an internal switch, the connector comprising a generally tubular body having a circular cylindrical internal passage therethrough, said passage having a front end and a rear end;

a first body of electrical insulating material having a generally cylindrical exterior dimensioned to be rotatably received in said passage adjacent said front end of said passage, said body including means defining electrically conductive female contact members exposed at one end of said first body in positions for receiving and making electrical contact with said blades of said plug, and means defining a first plurality of switch contact members including a ground contact member extending axially from a surface at the other end of said first body, said switch contact members being electrically connected to said female contact members within said body;

a second body of electrical insulating material having a generally cylindrical exterior dimensioned to be received in said passage, said second body having a front end facing toward said first body and including means defining a second plurality of switch contact members including a ground contact member extending axially at said front end of said second body toward said first body, said second plurality of contact members axially overlapping said first plurality of contact members, and terminal means at the rear end of said second body for connection to wires, said terminal means being electrically connected to said second plurality of switch contact members;

means for preventing rotation of said second body relative to said passage;

releasable stop means at the front end of said passage for limiting the extent of the rotation of said first body and confining said body substantially to a first position in which said first and second pluralities of switch contacts other than said ground contact members are separated from each other, said stop means being releasable to allow rotation of said first body through a predetermined angle to a second position in which said pluralities of contact members are in contact in pairs, thereby electrically interconnecting said blades with said terminal means.

2. A connector according to claim 1 wherein said tubular body includes means defining internal threads in a portion of said passage, and wherein said second body includes means defining external threads on said exterior thereof so that said second body is threadedly receivable in said passage.

3. A connector according to claim 2 wherein said first body also includes means defining external threads on said exterior thereof so that said first body is threadedly receivable in said passage.

4. A connector according to claim 1 wherein said tubular body includes means defining internal threads in a portion of said passage, and wherein said first body includes means defining external threads on said exterior thereof so that said first body is threadedly receivable in said passage.

5. A connector according to claim 4 wherein said stop means includes a fixed lug on said tubular body protruding radially inwardly at the front of said passage;

means on said first body defining a non-circular boss;

a locking ring having a non-circular opening shaped and dimensioned to receive said boss so that said locking ring and said body rotate together, and means defining a recess in said locking ring for receiving said lug, said recess subtending an angle no less than that of said lug, said locking ring being axially movable to separate said recess from said lug, thereby releasing said stop means.

6. A connector according to claim 5 and including a second lug on said tubular body diametrically opposite said first lug, said locking ring including means defining a second recess to receive said second lug.

7. A connector according to claim 6 and further including a compression coil spring between said first body and said locking ring urging said recesses into engagement with said lugs.

8. A connector according to claim 6 wherein said means defining a non-circular boss on said first body includes a shell having a transverse end wall, an axially extending wall surrounding a portion of said first body and a radially outwardly extending flange, said end wall having means defining openings therethrough shaped and positioned to receive plug blades.

9. A connector according to claim 6 wherein said ground contact member in said second plurality of switch contacts includes an arcuate electrically conductive plate subtending an angle at least equal to said predetermined angle, said plate having a concave surface facing inwardly, and said ground contact member in said first plurality of switch contact members includes a contact facing radially outwardly and abutting said concave surface at all rotational positions of said first body, said contact being in sliding engagement with said plate.

10. A connector according to claim 9 wherein said second plurality of switch contacts protrude from said rear face of said first body, and said second body includes a tubular, electrically non-conductive housing portion extending forward on said second body, said tubular housing portion surrounding said first and second pluralities of switch contacts to thereby completely enclose the switch components.

11. A connector according to claim 1 and further comprising detent means carried by one of said first and second bodies for cooperating with recess means in the other of said bodies to maintain said bodies in the one of the first and second positions in which it is placed.

12. A mating connector and plug, the plug having protruding blades and the connector having female conductive members for receiving the blades of the plug for completing an electrical connection, said connector having an internal switch, the connector comprising a generally tubular body having an internal passage therethrough, said passage having a front end and a rear end;

a first body of electrical insulating material having a generally cylindrical exterior dimensioned to be rotatable received in said passage adjacent said front end of said passage, said body including means defining said electrically conductive female contact members exposed at one end of said first body in positions for receiving and making electrical contact with said blades of said plug, and means defining a first plurality of switch contact members extending axially from a surface at the other end of said first body, said switch contact members being electrically connected to said female contact members;

a second body of electrical insulating material having a generally cylindrical exterior dimensioned to be received in said passage, said second body having a front end facing toward said first body and including means defining a second plurality of switch contact members extending axially toward said first body, said second plurality of contact members axially overlapping said first plurality of contact members, and terminal means at the rear end of said second body for connection to wires, said terminal means being electrically connected to said second plurality of switch contact members;

means for preventing rotation of said second body relative to said passage;

stop means at the front end of said passage for limiting the extent of the rotation of said first body and retaining said body in a position in which said first plurality of switch contacts are separated from each other, said stop means including first and second fixed lugs on said tubular body protruding radially inwardly at the front end of said passage, means on said body defining a non-circular boss, an axially movable locking ring having a non-circular opening shaped and dimensioned to receive said boss so that said locking ring and said first body rotate together, and means defining recesses in said locking ring for respectively receiving said lugs, each of said recesses subtending an angle no less than its associated lug; and spring means urging said locking ring recesses into engagement with said lugs;

said plug comprising a generally cylindrical body with said blades protruding from one end thereof and means at the other end for receiving a cable;

means at said one end defining a pair of L-shaped recesses for receiving said lugs when said plug is joined to said connector, said lugs and said L-shaped recesses forming a bayonet coupling permitting axial insertion of said blades followed by limited rotation;

said one end of said body having a rim with a diameter substantially equal to that of said locking ring so that the axial motion of joining said plug and connector moves said locking ring away from said lugs against the force of said spring means, allowing said first body to be rotated by said blades to a second position in which said pluralities of contacts are in contact in pairs, thereby electrically interconnecting said blades with said terminal means.

* * * * *